US005411603A

United States Patent [19]

Vial et al.

[11] Patent Number: 5,411,603

[45] Date of Patent: May 2, 1995

[54] METHOD OF PROTECTING MAGNETIC POWDERS AND DENSIFIED PERMANENT MAGNETS OF THE FE ND B TYPE FROM OXIDATION AND ATMOSPHERIC CORROSION

[75] Inventors: Fernand Vial, Meylan, France; Masato Sagawa, Kyoto, Japan

[73] Assignee: Ugimag SA, St. Pierre d'Allevard, France

[21] Appl. No.: 162,292

[22] Filed: Dec. 7, 1993

[30] Foreign Application Priority Data

Jan. 22, 1993 [FR] France ..... 93 00840

[51] Int. Cl.[6] ..... H01F 41/02

[52] U.S. Cl. ..... 148/101; 148/104; 148/105

[58] Field of Search ..... 148/101, 104, 105, 122

[56] References Cited

FOREIGN PATENT DOCUMENTS 61-124502 1/1986 Japan ..... 148/105

OTHER PUBLICATIONS

Patent Abstracts of Japan, vol. 13, No. 509 (E-846), Nov. 15, 1989, JP-12 05 502.

Journal of the Electrochemical Society, vol. 117, No. 4, Apr. 1970, pp. 537-540, Swisher et al.

*Primary Examiner*—John P. Sheehan

*Attorney, Agent, or Firm*—Dennison, Meserole, Pollack & Scheiner

[57] ABSTRACT

The invention concerns a method of protecting magnetic powders and permanent magnets containing at least one rare earth, at least one transition metal and boron from oxidation and atmospheric corrosion, by the introduction of gaseous fluorine during the grinding of the powders. It is characterized in that the fluorine is introduced by a mixture of $F_2+N_2$ during the fine grinding of the powders, the mixture containing from 1 to 100 ppm (by volume) of fluorine, and preferably from 1 to 10 ppm. The powders thus obtained are far less reactive and the densified magnets are far more resistant to atmospheric corrosion than non fluorinated powders and magnets obtained therefrom.

6 Claims, No Drawings

METHOD OF PROTECTING MAGNETIC POWDERS AND DENSIFIED PERMANENT MAGNETS OF THE FE ND B TYPE FROM OXIDATION AND ATMOSPHERIC CORROSION

The invention concerns a method of protecting magnetic powders and permanent magnets of the transition metal—rare earth metal type from oxidation and atmospheric corrosion by the introduction of gaseous fluorine during the grinding of the powders. It applies more particularly to powders and magnets of the transition metal—rare earth—boron family, where the metal is essentially iron and the rare earth essentially neodymium and/or praseodymium.

The inclusion of fluorine in sintered magnets of the Fe Nd B type is known, particularly from patent application JP 3-188241 in the name of SUMITOMO, in which the fluorine is introduced via a Li fluoride during the pulverising grinding process, or application JP 62-188757 in which the magnet contains a fluoride of Ba, Sr, Ca or Pb.

However, these magnets and the production method have the following disadvantages:

Homogeneous dispersion of a powder which forms a small proportion of a given mixture is a difficult operation to carry out. The additions introduce reactive third elements (Li, Ba, St, Ca), the action of which on oxidation and corrosion is uncertain and probably harmful.

In order to avoid these disadvantages, the method of the invention, which is illustrated here by an example, comprises introducing a mixture of $N_2+F_2$, which may contain from 1 to 100 ppm by volume of fluorine, and preferably from 1 to 10 ppm, in a jet mill at the fine grinding stage, with the normal vector gas flow rates and grinding times for this operation (for example 100 $Nm^3/h$ of nitrogen at a relative pressure of 0.5 Pa, for 3 hours).

The optimum fluorine content of the powders and sintered magnets is from 600 to 2000 ppm.

Below 600 ppm there is inadequate resistance to oxidation of the powders and to corrosion of the magnets in a humid atmosphere; above 2000 ppm densification defects during densification and weaker intrinsic coercive fields are found.

Densified magnets obtained by this method have the following advantages over prior art magnets:

- the introduction of fluorine in gaseous form enables the whole developed surface of the powder to be passivated uniformly and effectively
- the introduction of fluorine reduces the intake of oxygen during the grinding phase by a factor of about 2.

It is consequently possible to reduce the content of rare earths (RE) which are not trapped in the form of oxides, and this allows a gain of about 0.04 T in remanence per % reduction of the total content of rare earths.

The powders treated with fluorine are more stable relative to atmospheric oxidation.

The resistance of the densified magnets to humid atmospheric corrosion is considerably increased.

The grinding of the powders is easier.

The invention will be understood better from the following examples:

EXAMPLE 1

A magnetic powder of the following chemical composition (% by weight)

| Nd | Pr | Dy | B | Nb | Al | Cu | Fe |
|---|---|---|---|---|---|---|---|
| 28.6 | 0.3 | 2.75 | 1.07 | 0.97 | 0.37 | 0.039 | Remainder |

obtained by treating ingots which have been ground mechanically to a mean particle size of 500 μm, in $H_2$ at 400° C., is pulverised in a jet mill with a chamber of approximately 2 litres, by a mixture of $N_2+F_2$ at a rate of 100 $m^3$/hour at a relative pressure of 0.5 MPa for 3 hours, under the conditions given in Table I.

The flow rate of the gaseous mixture of $F_2+N_2$ is checked by a calibrated nozzle and by the difference in pressure upstream and downstream of the nozzle. Comparative tests are carried out without the introduction of fluorine.

The powders thus obtained are compressed axially in a 1.1 T axial field at a pressure of 1.6 $t/cm^2$, into cylindrical samples 15 mm in diameter and 12 mm high.

In these examples densification is obtained by sintering, carried out under vacuum at temperatures from 1060° to 1090° C. for 4 hours.

The blanks thus obtained undergo the normal heat treatments for magnetic hardening, adjusted according to the content of rare earth.

The following are recorded:

- the intake of oxygen from ambient air (23° C., 55% relative humidity) by powders ground for up to 24 hours (Table II)
- the magnetic properties of the densified magnets (Table III)
- their resistance to corrosion in a humid environment is characterised by the weight loss of samples cleaned by ultrasound, after being kept under the following conditions:

115° C., 0.15 MPa 100% relative humidity, up to 120 hours (Table IV)

TABLE I

| Test N° | Dilution of fluorine in nitrogen (by vol) | Pressure atm | Nozzle mm | Flow rate of mixture (1/h) | Flow rate of fluorine (1/h) | Dilution of fluorine in chamber (by volume)* |
|---|---|---|---|---|---|---|
| 1 | 2.5% | 0.5 | 7/100 | 4.0 | 0.1 | 1.0 |
| 2 | 2.5% | 4 | 8/100 | 15.7 | 0.4 | 4.0 |
| 3 | 10% | 1.8 | 8/100 | 7.0 | 0.7 | 7.0 |
| 4 | 0% | — | — | — | — | — |

*with a nitrogen flow rate of 100 $m^3$/hr

TABLE II

| Test No. | Particle size* | Fluorine ppm** | Oxygen (ppm) t = 0 | t = 1 h | t = 7 h | t = 24 h |
|---|---|---|---|---|---|---|
| 1 | 4.6 | 580 | 3660 | 4040 | 4200 | 4300 |
| 2 | 4.6 | 1500 | 3040 | 2900 | 3220 | 3600 |
| 3 | 5.4 | 2070 | 2773 | 3060 | 3030 | 3310 |
| 4 | 5.0 | 70 | 3940 | 4090 | 4200 | 4560 |

*Fisher sub size sieve
**in powders

TABLE III

| Test N° | Fluorine *ppm | Sintering T (°C.) | Last anneal T (°C.) | Density | Br kG | Hcj kOe |
|---|---|---|---|---|---|---|
| 1 | 630 | 1060 | 580 | 7.56 | 11.6 | 18.7 |
| | | 1070 | 580 | 7.58 | 11.6 | 17.0 |
| | | 1080 | 560 | 7.56 | 11.6 | 15.6 |
| | | " | 580 | 7.56 | 11.6 | 18.1 |
| | | " | 600 | 7.56 | 11.6 | 18.6 |
| | | " | 620 | 7.56 | 11.6 | 17.5 |
| | | 1090 | 580 | 7.57 | 11.6 | 17.5 |
| 2 | 1500 | 1060 | 580 | 7.40 | 11.6 | 18.1 |
| | | 1070 | 580 | 7.47 | 11.6 | 14.5 |
| | | 1080 | 560 | 7.53 | 11.8 | 14.9 |
| | | " | 580 | 7.53 | 11.8 | 16.5 |
| | | " | 600 | 7.53 | 11.8 | 17.4 |
| | | " | 620 | 7.53 | 11.8 | 15.9 |
| | | 1090 | 580 | 7.54 | 11.8 | 17.2 |
| 3 | 2100 | 1060 | 580 | 7,25 | 11.4 | 14.9 |
| | | 1070 | 580 | 7.32 | 11.4 | 14.2 |
| | | 1080 | 560 | 7.39 | 11.4 | 13.8 |
| | | " | 580 | 7.39 | 11.4 | 14.9 |
| | | " | 600 | 7.39 | 11.4 | 15.9 |
| | | " | 620 | 7.39 | 11.4 | 15.6 |
| | | " | 580 | 7.50 | 11.7 | 15.1 |
| 4 | 60 | 1060 | 580 | 7.54 | 11.7 | 18.1 |
| | | 1070 | 580 | 7.55 | 11.7 | 18.0 |
| | | 1080 | 580 | 7.57 | 11.7 | 18.1 |
| | | 1090 | 580 | 7.57 | 11.7 | 18.0 |

*in sintered magnets

TABLE IV

| N° | Fluorine ppm | Oxygen ppm | Exposure time (h) | Weight loss $10^{-5}$ (g) | % | (g/m2) | Rate of weight loss (g/m2h) |
|---|---|---|---|---|---|---|---|
| 4 | 60 | 3750 | 24 | 65 | 0,07 | 10,0 | 0,40 |
| | | | 48 | 102 | 0,11 | 15,0 | 0,31 |
| | | | 96 | 557 | 0,59 | 82,9 | 0,85 |
| | | | 120 | 660 | 0,71 | 100,0 | 0,83 |
| 2 | 1500 | 2440 | 24 | 68 | 0,07 | 10,0 | 0,40 |
| | | | 48 | 265 | 0,27 | 39,0 | 0,80 |
| | | | 96 | 107 | 0,12 | 16,0 | 0,16 |
| | | | 120 | 240 | 0,25 | 36,0 | 0,30 |

EXAMPLE 2

Powders of alloys of the initial composition given in Table V are developed and ground with a gas grinder with or without the introduction of fluorine, under conditions similar to those in Example 1, the fluorine content in the grinding chamber being 1 ppm (by volume) in nitrogen.

A check was made of the intake of oxygen during grinding, the stability of the powders relative to oxidation in air, under the same conditions as in Example 1, and the magnetic properties of the densified magnets prepared under the same conditions as in Example 1

TABLE V

| Test N° | Nd + Pr | Dy | B | Nb | Al | Cu | TRE* |
|---|---|---|---|---|---|---|---|
| 6 | 27.6 | 1.43 | 1.05 | — | 0,25 | 0.0295 | 29,03 |
| 7 | 28.7 | 1.47 | 0 95 | — | 0 24 | 0.034 | 30.17 |
| 8 | 29 10 | 1 46 | 0 94 | — | 0 24 | 0.032 | 30.56 |
| 9 | 28 50 | 2 62 | 1 10 | 1 0 | 0.37 | 0 040 | 31.50 |

*TRE = total rare earths

TABLE VI

| Test N°* | | Intake of oxygen (ppm) During grinding | In air = 0 h | = 1 h | = 7 h | = 24 h |
|---|---|---|---|---|---|---|
| 6 | F | 1156 | 3055 | 3046 | 3763 | 3563 |
| | — | 1856 | 3743 | 4060 | 4672 | 4587 |
| 7 | F | 1100 | 2500 | 2513 | 3361 | 4027 |
| | — | 1302 | 2710 | 4139 | 4267 | 4598 |
| 8 | F | 572 | 2451 | 2780 | 3750 | 4060 |
| | — | 1078 | 2957 | 4045 | 4031 | 4723 |

TABLE VI-continued

| Test N°* | | Intake of oxygen (ppm) During grinding | In air = 0 h | = 1 h | = 7 h | = 24 h |
|---|---|---|---|---|---|---|
| 9 | F | 912 | 2185 | 2700 | 3360 | 3505 |
| | — | 1327 | 2600 | 4138 | 4267 | 4598 |

*F: with fluorine-: without fluorine

TABLE VII

Magnetic properties and content of fluorine, nitrogen and oxygen

| Test N° | | d | (T) | Hcj (kA/m) | Oxygen (ppm) | Nitrogen (ppm) | Fluorine (ppm) |
|---|---|---|---|---|---|---|---|
| 6 | F | 7.52 | 1.27 | 960 | 2350 | 175 | 1400 |
| | — | 5,2 | — | — | 5450 | 192 | 0 |
| 7 | F | 7,55 | 1.22 | 1090 | 2000 | 198 | 1500 |
| | — | 6.90 | — | — | 4380 | 303 | 0 |
| 8 | F | 7,56 | 1.24 | 1010 | 2868 | 234 | 1600 |
| | — | 7,46 | 1.20 | 986 | 3030 | 261 | 0 |
| 9 | F | 7,52 | 1.18 | 1289 | 2767 | 161 | 1600 |
| | — | 7,44 | 1.16 | 1312 | 2698 | 216 | 0 |

The introduction of fluorine during fine grinding is found to give powders good stability in air and to produce magnets with high magnetic properties, particularly when the total content of rare earths is less than 30%.

This method has been illustrated within the range of powders and magnets produced by sintering the powders, of the $RE_2Fe_{14}B$ type enriched with rare earth. These fine powders are generally obtained from ingots of alloy, but they may equally be obtained from coarse powders obtained by the so-called reduction-diffusion process.

What is claimed is:

1. A method of protecting magnetic powder and densified permanent magnets produced therefrom from oxidation and atmospheric corrosion, said powder containing at least one rare earth element, at least one transition metal element and boron, comprising introducing fluorine into the powder utilizing a gaseous mixture of fluorine and nitrogen during fine grinding of the powder, the gaseous mixture containing from 1 to 100 ppm by volume of fluorine, to obtain the protected powder.

2. A method according to claim 1, wherein the fluorine content of the gaseous mixture is from 1 to 10 ppm by volume.

3. A method according to claim 1, wherein the powder obtained contains from 600 to 2000 ppm of fluorine.

4. A method according to claim 1, additionally comprising densifying the protected powder to obtain a permanent magnet containing from 600 to 2000 ppm fluorine.

5. A method according to claim 2, where the powder contains from 600 to 2000 ppm fluorine.

6. A method according to claim 2, additionally comprising densifying the protected powder to obtain a permanent magnet containing from 600 to 2000 ppm fluorine.

* * * * *